United States Patent [19]

Drennan

[11] Patent Number: 4,924,930

[45] Date of Patent: May 15, 1990

[54] WINDOW ASSEMBLY

[76] Inventor: Craig Drennan, 2100 Sherobee Road, Mississauga, Ontario, Canada, L5A 4C5

[21] Appl. No.: 234,007

[22] Filed: Aug. 16, 1988

Related U.S. Application Data

[63] Continuation of Ser. No. 933,204, Nov. 21, 1986, abandoned.

[51] Int. Cl.[5] ..... E06B 9/00

[52] U.S. Cl. ..... 160/90; 160/371; 49/450; 49/130

[58] Field of Search ..... 160/90, 87, 89, 101, 160/371, 379, 380; 49/450, 453, 128, 129, 130

[56] References Cited

U.S. PATENT DOCUMENTS

| | | | |
|---|---|---|---|
| 878,253 | 2/1908 | Straubhaar | 49/128 |
| 1,078,369 | 11/1913 | Nikolaus | 49/128 |
| 2,577,379 | 12/1951 | Spears et al. | 160/379 |
| 2,617,482 | 11/1952 | Wagner | 160/371 |
| 2,759,538 | 8/1956 | Long | 160/379 |
| 2,762,430 | 9/1956 | Sylvan | 160/379 X |
| 3,080,620 | 3/1963 | Mendelsohn | 160/90 X |
| 3,081,503 | 3/1963 | Mendelsohn | 160/90 X |
| 3,083,419 | 4/1963 | Pennington et al. | 160/90 X |
| 3,107,991 | 10/1963 | Taussig | 160/371 |
| 3,377,747 | 4/1968 | Donkin | 49/453 X |
| 3,694,959 | 10/1972 | Gartner | 49/128 |
| 4,311,183 | 1/1982 | Herbst et al. | 160/90 X |

*Primary Examiner*—Ramon S. Britts
*Assistant Examiner*—David M. Purol
*Attorney, Agent, or Firm*—Fetherstonhaugh & Co.

[57] ABSTRACT

This invention relates to a window assembly with a window frame having a first window sash mounted fixedly in the frame and a second window sash mounted for movement between a closed position and at least one open position in parallel relation to the first sash. The window frame has a main frame and an auxiliary frame that mates with the main frame to define a common frame outline and to combine with at least one of the sash to define guideways to guide the second sash as it moves between the closed position and an open position.

19 Claims, 6 Drawing Sheets

WINDOW ASSEMBLY

This application is a continuation of application Ser. No. 933,204, filed 11/21/86 now abandoned.

FIELD OF INVENTION

This invention relates to a window assembly of the double hung type wherein there are two window panes, one fixedly mounted in the window frame and the other manually moveable from a closed position to an open position.

DESCRIPTION OF PRIOR ART

The essential parts of these assemblies are usually manufactured from lengths of a plastics or metal material that is extruded from extrusion dies. The frame and sash rails are cut from the extruded lengths and mitered together to form a frame according to well established window practice.

This window has a design that is adapted to an injection moulding process of manufacture wherein the frame and sash members are moulded in one piece.

The design is one that can be easily assembled and that achieves effective seals of the adjustable parts with a minimum of structure.

In the design the moveable window moves from a closed position wherein the window panes of the moveable window and the fixed window are in the same plane to an open position wherein the plane of the moveable window is behind and parallel to the plane of the fixed window. A screen for the assembly is also injection moulded and is bodily inserted into the frame. The frame of the screen can be formed with a suitable flexible strip that acts as a weather strip between the lower sash and the frame when the lower window is actuated to a closed position.

The moulding technique is suited to the incorporation of an effective handle and lock configuration that permits release of the locking arrangement of the window with single hand operation.

SUMMARY OF INVENTION

A window according to the present invention comprises a frame having a window opening area for a first sash and a second sash; a first window sash mounted in the frame; a second window sash mounted in the frame for movement between a closed position closing its respective window opening area to at least one open position in parallel relation to the first sash and exposing at least part of its respective window area, said frame having a main frame of moulded construction and an auxiliary frame of moulded construction that mates with the main frame to define a common frame outline and to combine with at least one of said sash to define guideways to guide said second sash as it moves between said closed position and said open position.

BRIEF DESCRIPTION OF THE DRAWINGS

The invention will be clearly understood after reference to the following detailed specification read in conjunction with the drawings.

In the drawings.

DESCRIPTION OF THE PREFERRED EMBODIMENTS

Figure 1:
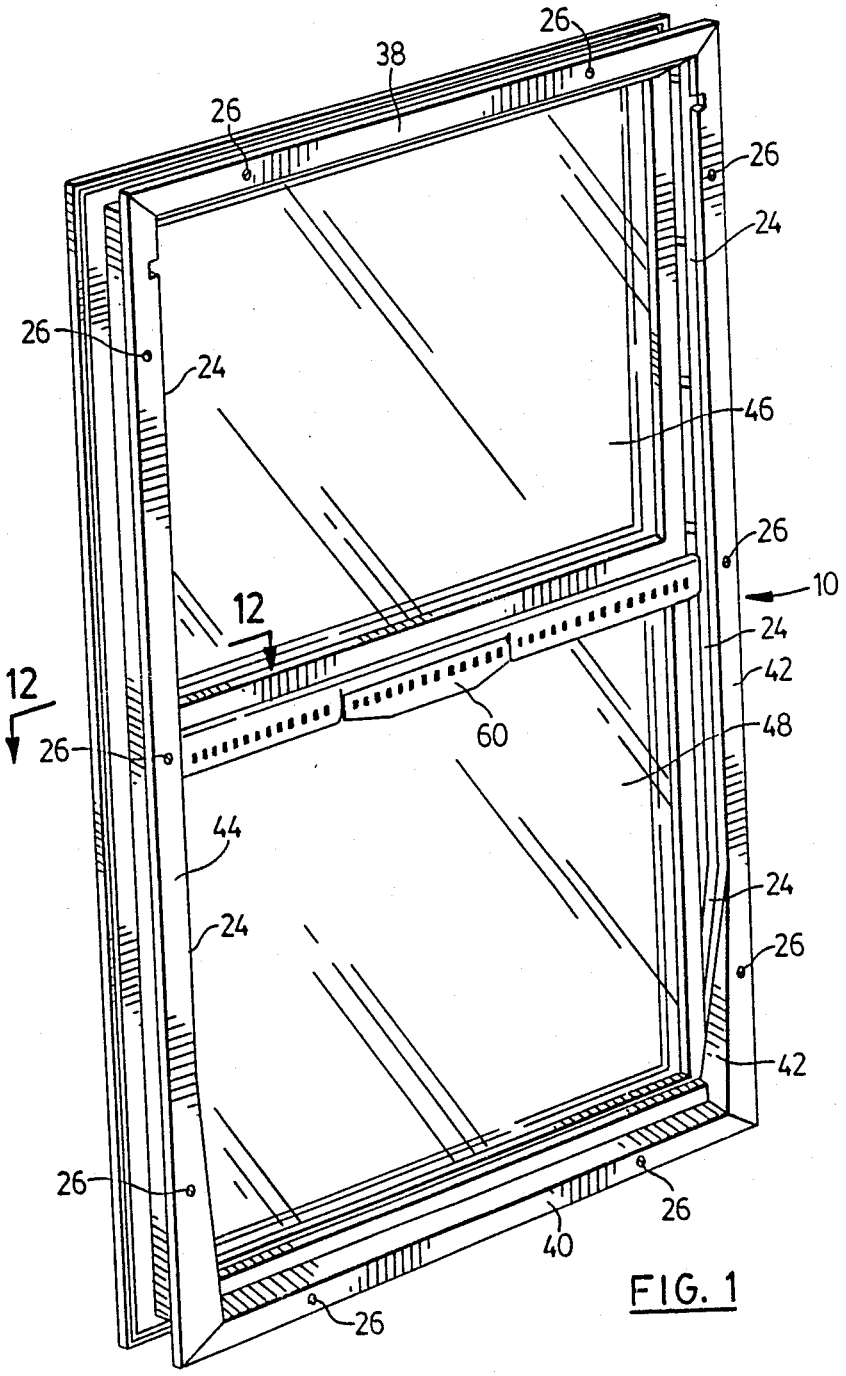
FIG. 1 is a perspective illustration of a window assembly according to the invention.

Referring to the drawings the numeral 10 generally refers to a window assembly. It has a frame within which two sash are mounted in double hung arrangement. With this arrangement one sash, usually the lower sash, can be moved between a closed position where it underlies the upper sash to an open position where it is parallel to the other sash.

The present frame and window sash assembly represent quite a departure from normal practice. The component members of the assembly are injection moulded. With injection moulding it is possible to achieve good control of manufacturing tolerances so that one can take advantage of different sealing techniques to those used with this general kind of construction between the glass and the window sash. The concept of moulding the frame members within which the window sash are mounted also permits the adoption of a track mounting for the moveable window sash that is efficient in use and easy to manufacture.

Figure 2:
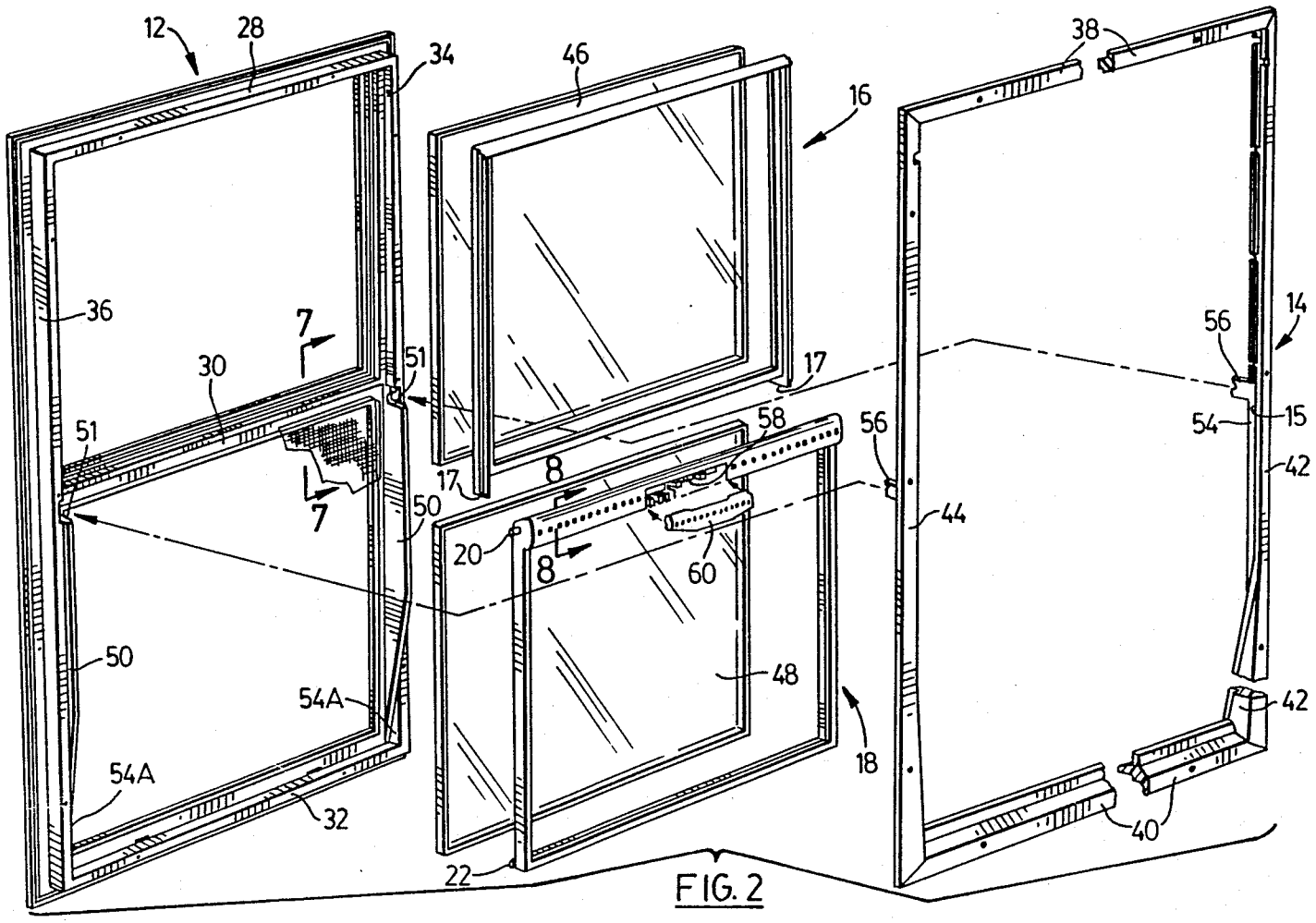
FIG. 2 is an exploded illustration of the assembly of FIG. 1 showing the two parts of the frame and the sash which are mounted in the frame.
Figure 3:
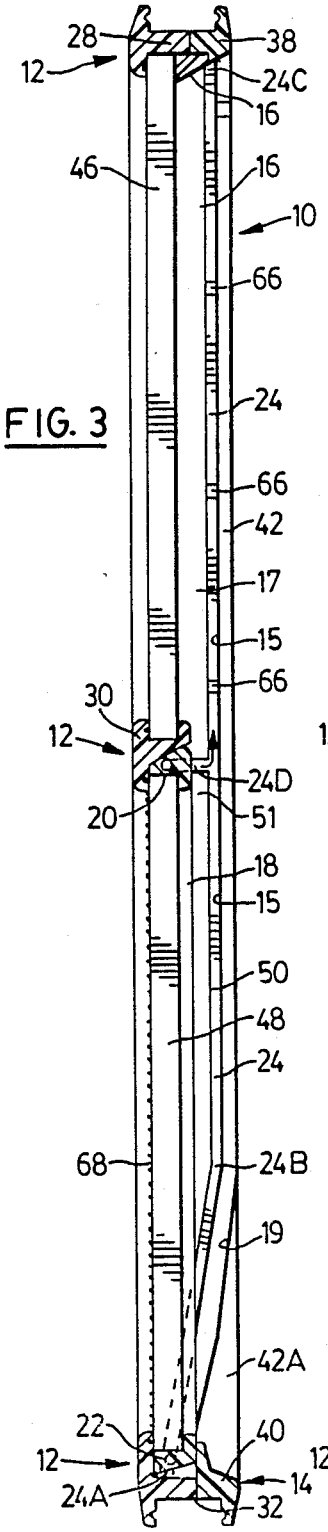
FIG. 3 is a longitudinal sectional view of the window assembly showing the sash in the closed position.
Figure 5:
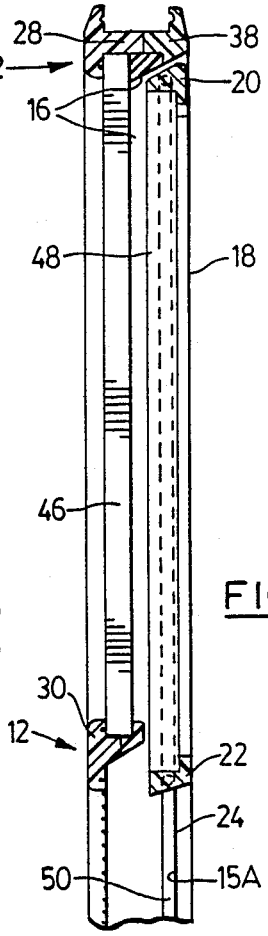
FIG. 5 is a view similar to FIG. 4 but showing the adjustable sash in the fully raised position.

FIG. 2 is a general illustration of the principle constituent parts of the assembly. The frame for the window sash has a main frame 12 and an auxiliary frame 14. The main frame mates with the auxiliary frame to house the upper window sash 16 in fixed relation and the lower window sash 18 in sliding relation between a closed position wherein it is coplanar with the upper window sash 16, as illustrated in FIG. 3, and an open position where it is in parallel relation as illustrated in FIG. 5. The lower window sash moves between the lower position and the upper position as the ends of laterally extending guide rods 20 and 22 travel along guideways 24 that are defined by the frame and window sash members 12, 14 and 16. The main frame 12 and auxiliary frame 14 are held in assembled position by means of screws 26 (see FIG. 1).

The main frame 12 has an upper horizontal rail 28, a cross or intermediate rail 30, a bottom horizontal rail 32, a right vertical rail 34 and a left vertical rail 36. The auxiliary frame 14 has an upper horizontal rail 38, a lower horizontal rail 40, a right vertical rail 42 and a left vertical rail 44.

The upper window sash 16 consists of a sash frame **16*a* which has a double pane window 46 mounted therein and is positively located in the assembly by the mating frame members as will be apparent from an examination of FIG. 3** of the drawings.

Figure 4:
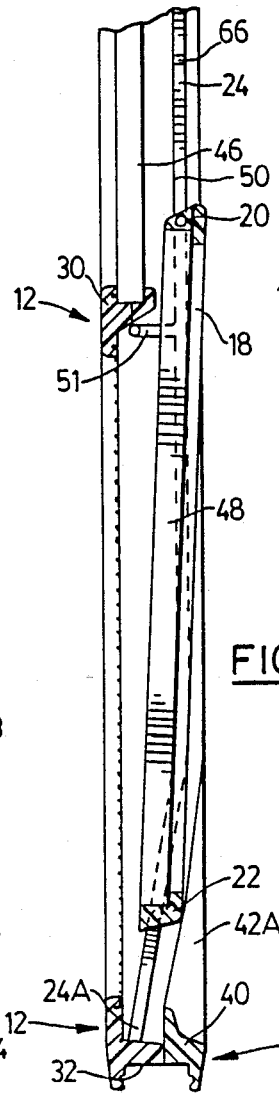
FIG. 4 is a partial illustration similar to FIG. 3 but showing the adjustable sash in the early stages of opening.

The lower sash 18 consists of a sash frame **18*a* which is rebatted to receive its double pane window 48. FIGS. 3 to 5 illustrate the movement of the lower window sash from its closed position to its open position. In this movement, it is guided by the upper and lower guide rods 20 and 22 as they travel in the guideways 24** on each side of the frame.

The guideways 24 as viewed in FIG. 3 extend from a lower end **24*a* upwardly and rearwardly to the right to a point 24*b* and then upwardly to the upper end 24*c*. There is a stub guideway 24*d* that extends forwardly about midway along the extent of the vertical guideway 24. These guideways are essentially a channel in which the free ends of the guide rods 20 and 22 travel. Starting from the bottom 24*a*, the left hand side of the main guideway 24 as viewed in FIG. 3 is formed by an edge of the flange 50 on the main frame of the body. Beyond the stub guideway 24*d*, the left hand side of the guideway is formed by the longitudinally extending flange 17 on the upper window sash 16. The right hand side of the guideways 24 is formed by an inwardly directed face 15** of the auxiliary frame that extends from top to bottom, except near the bottom where part of the continuing face is on the main frame.

The stub guideway **24*d* extends to the left of the main guideway as viewed in FIG. 3 and is defined by the end of the flange 17 of the upper sash 16 and the end of the flange 50** on the main frame.

The upper guide rods 20 are spring urged outwardly, as will be explained later, and on moving up the guide track 24 are restrained against full outward movement by a surface on the auxiliary frame. Frame 14 has a forward extension 56 (FIG. 2) which extends inwardly of and forms the restraining surface for the guide rods 20 on the stub guideway. Extension 56 terminates short of the inward extent of the stub guideway **24*d* so that when the window is in the position of FIG. 1, the guide rods 20 can extend over and beyond the free end of the extension 54 to the position illustrated in FIG. 12** to lock the window sash closed in the frame. The locking arrangement can be released as will be explained later.

In the position of FIG. 3, the lower guiderods of the lower window sash 18 are resting at the bottom location **24*a* of the guideway 24. The free ends of the upper guide rods are at the extremity of the stub passage 24*d* and locate the window sash 18 against the middle horizontal rail 30 of the main frame 12. The spring urged guide rods 20 extend laterally beyond the free end of the extension 56 of the auxiliary frame 14 and lock the guide rods 20 from movement outwardly of the stub guideway 24*d*. The lock can be released by manually actuating the upper guide rods 20** inwardly as will be explained.

Figures 10, 11:
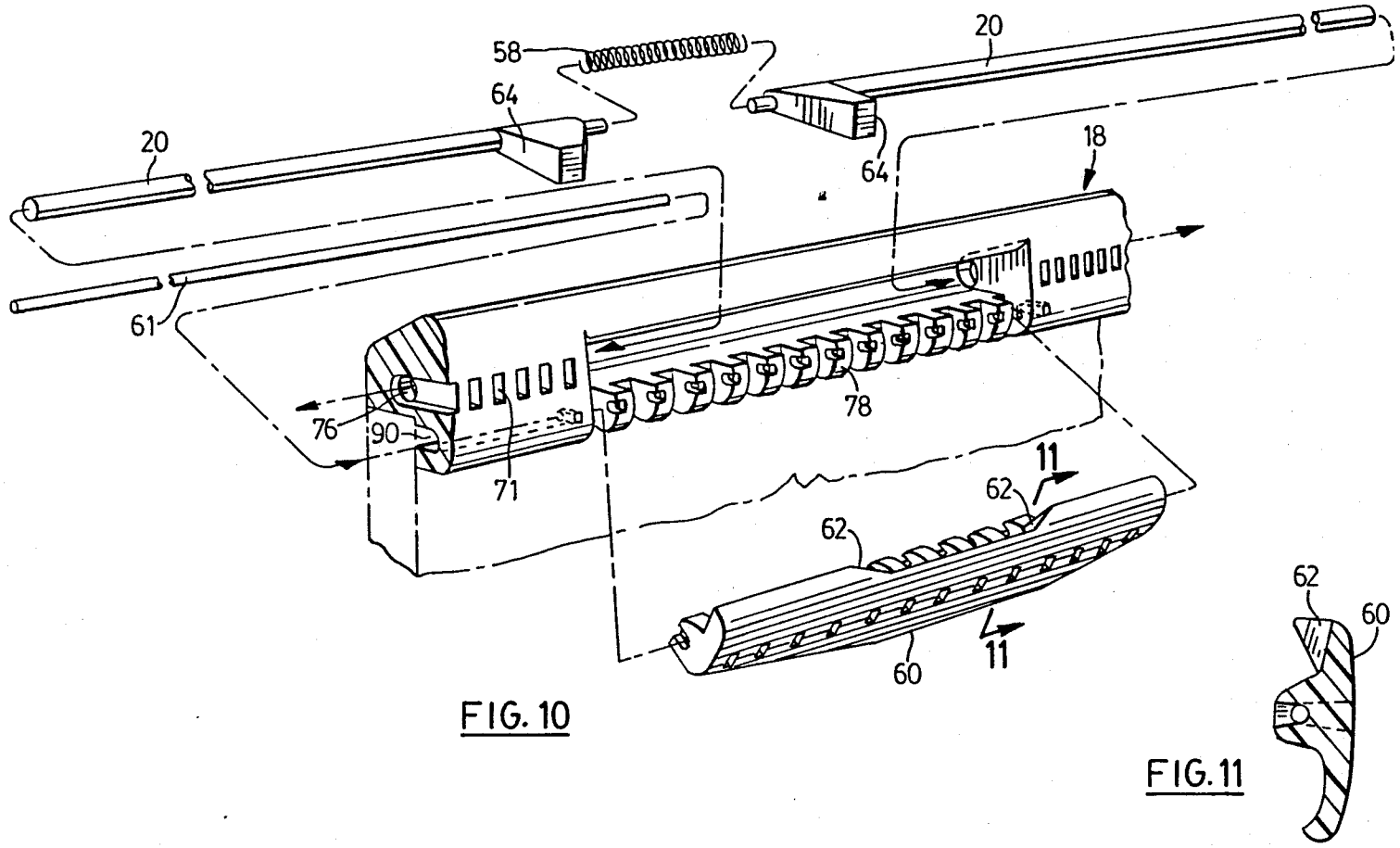
FIG. 10 is an exploded illustration showing the operation of the latch release for the lower sash.
FIG. 11 is an illustration along the line 11—11 of FIG. 10.
Figure 12:
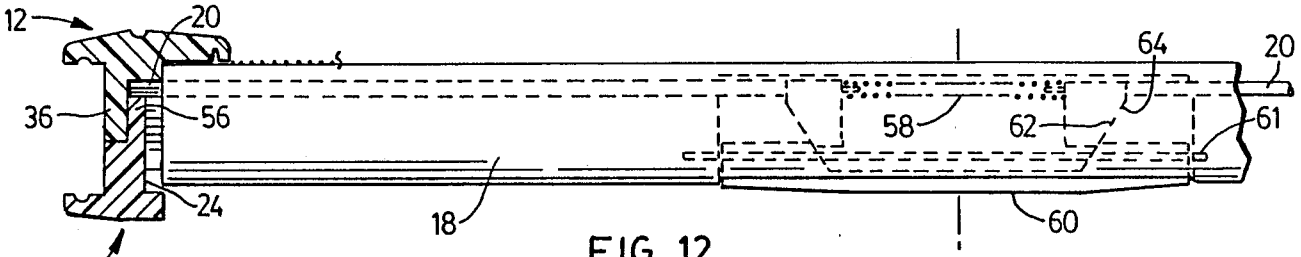
FIG. 12 is an illustration along the line 12—12 of FIG. 1 showing the operation of the latch.
Figure 13:
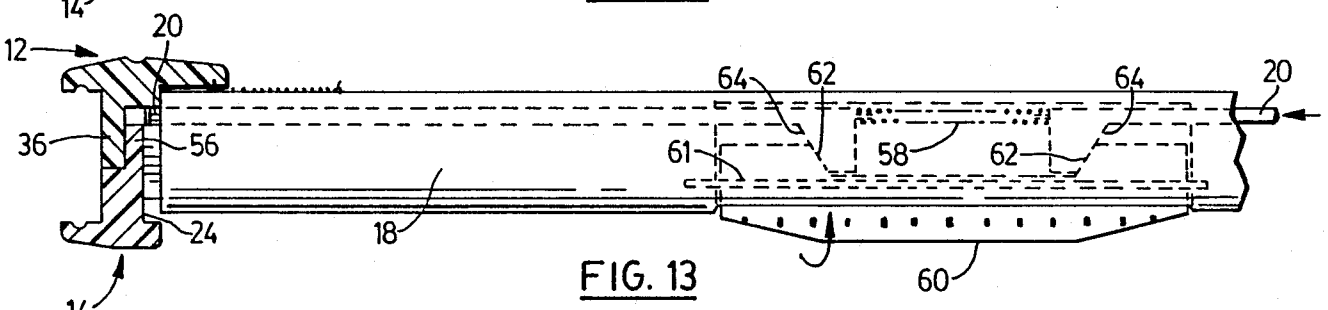
FIG. 13 is a view similar to FIG. 12 but showing the latch released.
Figure 14:
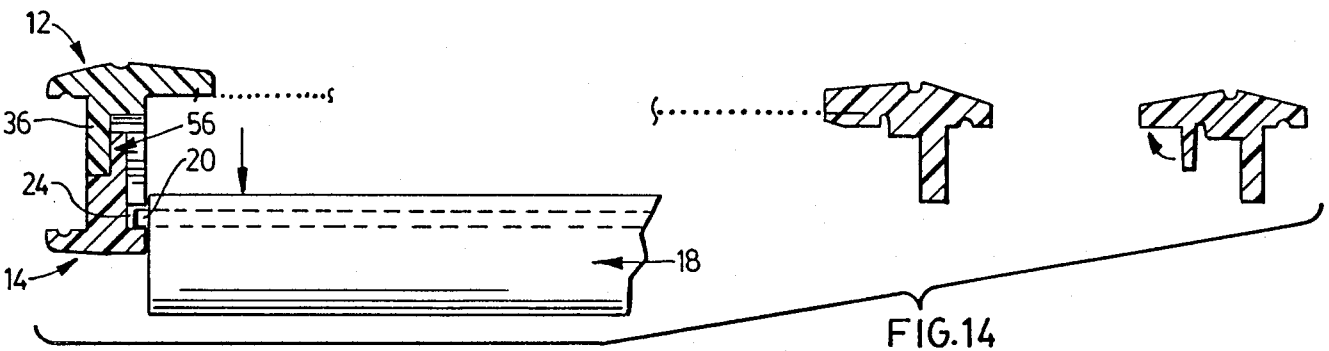
FIG. 14 is a view similar to FIGS. 12 and 13 but showing the sash fully moved into its outer most position in the stub guide track as the adjustable sash is raised.

The upper guide rods 20 are mounted for reciprocation in the transverse rail of the lower window sash 18 and are urged outwardly by the compressed spring 58 (FIGS. 10 and 12). A handle 60 swingably mounted on a rod 61 in the lower window sash has cam surfaces 62 which engage with cam surfaces 64 of the guide rods 20 when the handle is rotated in an upward direction against the force of the spring to move each of the actuating rods 20 inwardly to the position of FIG. 13. In this position the lock is released and the upper end of the lower window sash can be pulled rearwardly of the frame to move the guide rods 20 along the stub guideway **24*d***.

Once the guide rods 20 are moved to the rearward extremeties of stub guideways **24*d* they enter the main guideway. From this position it is moved upwardly to carry the lower window sash into parallel relation with the upper window sash. As it does so, the lower guide rods 22 follow the guide path 24**.

The surface of the auxiliary frame 14 against which the spring urged guide rods 20 extend under the force of the spring 58 is formed with a series of notches 66 along its extent into which the guide rods 20 can extend as the window is raised if lifting pressure on the handle is released. These notches will maintain the lower window sash in a position corresponding to the notch so that positions of opening between that illustrated in FIG. 3 and that illustrated in FIG. 5 can be achieved. One can release the guide rods 22 from locked relation in a notch 66 by rotation of the handle 60 to draw them inwardly as explained above.

Formed on the lower portion of the vertical rails of the auxiliary frame are inwardly extending shoulders **42*a*. These shoulders 42*a* engage the front surface of the lower window sash to assist the guide rods in the guiding function as the lower window sash is raised from or lowered into its position shown in FIG. 3**.

Figure 6:
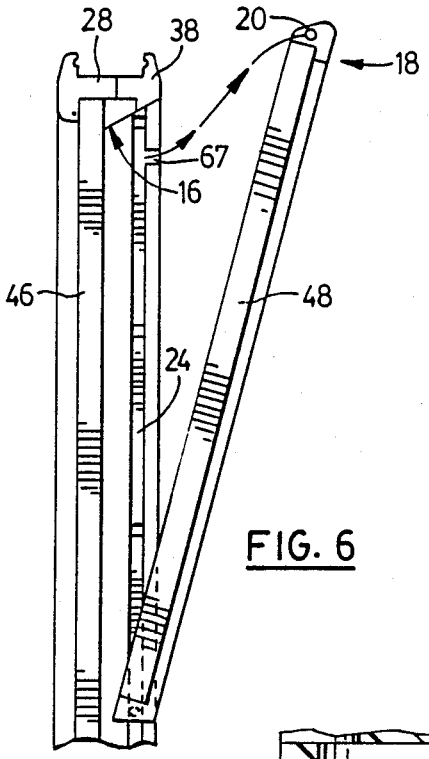
FIG. 6 is a view similar to FIG. 5 but showing the removal of the adjustable sash.

It is also possible to remove the lower window sash from the frame. Close to the upper extremity **24*c* of the guideway 24 there is an exit slot 67 on each side of the auxiliary frame through which the extended guide pins can be pass as illustrated in FIG. 6. In FIG. 6 the upper guide pins have been shown released from the slot. To remove the lower window sash it is merely necessary to operate the handle 60 to release the guide rods and to raise the lower window sash to its upper position from which it can be withdrawn from the frame by guiding the guide rods 20 through the slot 67**.

As noted above the sash frames and frame members of this window assembly are formed in one piece by an injection moulded process. The window assembly has a screen 68 over the lower half of the frame, the frame of which is also injection moulded in one piece. At the time of moulding the screening is applied to the mould and is set into the moulded material of the screen. Thus the screen can be formed in one simple operation and once formed is simply inserted in sealing relation into a peripherally extending slot in the main frame 12.

High pressure and low pressure injection moulding techniques are available. Low pressure technique is preferred for all frames except the screen frame. High pressure moulding time is shorter than low pressure moulding time but does not achieve as high a structural strength because the part cross section is limited. The screen has a smaller cross section and higher pressures are practical. A person skilled in the art would have no difficulty selecting the proper moulding technique having regard to his strength and cost requirements. High impact heat resistant structural styrene is satisfactory for frame members. The screen is preferably a neoprene. Other materials are known and usable.

Figure 7:
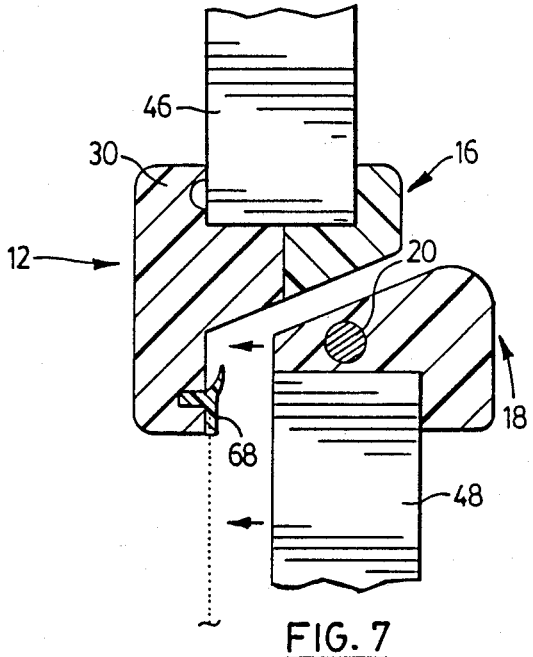
FIG. 7 is an enlarged sectional exploded illustration showing the meeting of the lower bar of the upper sash and the upper bar of the lower sash and illustrating the screen that extends over the opening of the lower sash when the lower sash is raised.

FIG. 7 shows a cross-section of the screen moulding. It has a flexible outer marginal area against which the lower window sash 18 can close and form a good seal in the closed operation.

Figure 9:
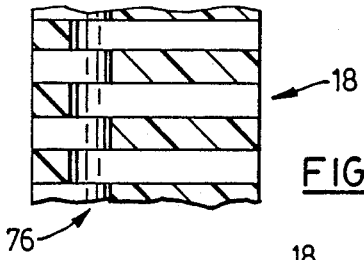
FIG. 9 is a view along the line 9—9 of FIG. 8.
Figure 8:
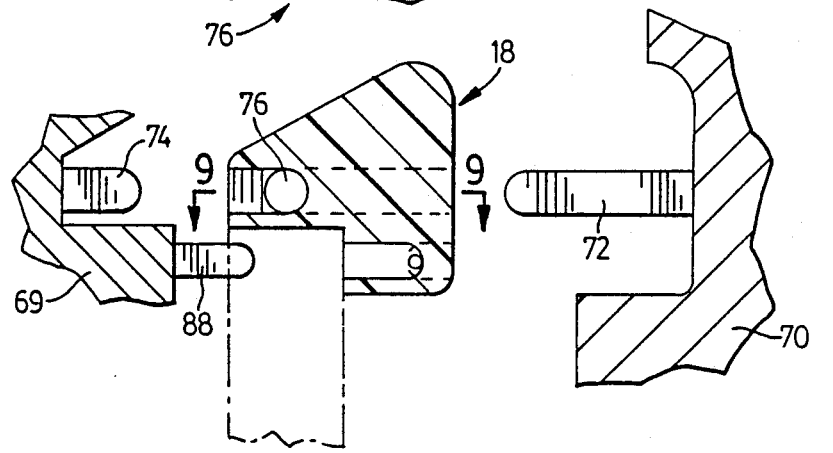
FIG. 8 is an illustration showing the manner of moulding the upper rail of the lower sash.

The manner of moulding the lower sash at the top rail is illustrated in FIGS. 8 and 9. The moulds which forms this window sash frame 18*a* are generally indicated by the numerals 69 and 70 insofar as the top rail is concerned.

It will be recalled that there are two plastics shafts mounted in the top rail of the lower window sash. The first shaft is the guide rods 20; the second is the shaft 61 for the handle 60. Provision for the mounting of these shafts is achieved by the cooperating moulds 69 and 70 which come together to form the sash frame.

Provision for the guide rods 20 is achieved by a series of opposed cores 72 and series of cores 74. These cores are rectangular in section and of equal width along the length of the horizontal rail of the sash. Thus each series moulds a series of spaced apart openings on its respective side of the rail of the mould. The extremeties of the openings formed by the cores overlap so that the overlapping extremeties combine to form a circular hole 76 that extends longitudinally of the rail of the sash for the extent of the cores. In this way continuous holes 76 are provided in the rail of the sash to accommodate the guide rods. Sash member as viewed in FIG. 10 shows a series of holes 71 that are formed by the mould cores 72.

The passage through the finger 78 is achieved by cooperating die cores which enter the cavity from opposed directions and have an overlapping end to form a continuous through hole 76.

Numeral 88 refers to an elongated bar that forms a slot 90 in the horizontal bar of the lower window sash.

The handle member 60 is mounted on the rail of the sash 18*a* by the formation of a series of cores 78.

It will be apparent that one can slide the pin 61 upon which the handle is mounted into the slot 90 and from the slot through the continuous through holes in the cores 78 to achieve a mounting for the handle as described above. The opening of the slot 90 is covered when the window is assembled by the upper edge portion of the lower glass section 48. It is therefore hidden from view after the window has been assembled.

The handle is similarly formed by moulding cores and is illustrated in cross-section in FIG. 11. Thus the frame can be moulded even though it provides for the mounting of rods for operation of the locking handle and guide bars.

The window frame illustrated is for use in a door and it will be noted that the assembled window has an exterior channel therearound, the sides of which extend over the marginal areas of a window opening cut in the door in the usual way.

In use the window unit is temporarily assembled by the window manufacturer who would ship it in a container to a door manufacturer.

The upper window sash 16 includes a thermal window glass 46. The upper window sash 16 is mounted into the main frame with suitable caulking sealants. Once mounted in the frame the upper window sash 16 is secure against movement in all directions. It will be noted that the intermediate rail 30 of the main frame secures the window pane 46 against movement in a vertical direction.

The screen is mounted to the main frame by pressing it into a groove that extends around the main frame.

The lower window sash frame 18*a* and its window pane 48 are then assembled. In this connection the window pane 48 is positively secured within its sash frame 18*a* by means of a polysulphide adhesive that secures glass to plastics materials very positively. It will be noted that the front face of this unit is flat and that it will form a good seal against the resilient flap of the screen when closed. It will also be noted that the upper edge of the lower sash frame sash of has a slope from back to front and is complimentary to a similar slope on the main frame and upper sash frame as is apparent from a consideration of FIG. 3.

The lower window assembly once completed is placed in position similar to the position illustrated in FIG. 3 and the auxiliary frame member is applied to complete the assembly.

The assembly is stapled together in this position for shipping.

When the unit reaches the door factory for assembly into the door the usual procedure is to lay the assembly with the main frame down onto an assembly table. The auxiliary frame is removed. The door is then applied over the window with the bottom of the channel between the frames extending through the door opening. An operator then merely takes the auxiliary frame and applies it to the main frame and secures the frames together by means of the screw bolts 26. Once tightened the window is firmly in place with the flanges of the assembly tightened against the marginal area of the window opening in the door. From this position the moveable window sash can be opened or closed as described.

Procedures other than the one described will be apparent to those skilled in the art.

The moulded window is a new concept in door and like windows. Previous designs have at least some frame members that are fabricated from extruded rail members. This assembly can be made with none.

The locking device in which the action is centered at the center of the window and is activated by an upward pull is also a step forward.

The single track design wherein the lower window travels from the same plane as the upper window when closed, to a parallel plane when open is a factor in the weather tight seal that is achieved between the glass of the window and the moulded gasket of the screen member when the window is closed.

The design is superior and cost of manufacture is less because the design eliminates cutting, notching, drilling and securing of the frame members. Maintaining tolerances with the former practice is also difficult. Tolerance with the moulded frames of this invention are automatically obtained once the mould has been made.

The invention has been described for application to the window opening of a door. It will be apparent that the invention has application to other situations and it is not intended that the invention should be restricted by the foregoing description of the best embodiment known to the inventor at the present time.

I claim:

1. A window assembly comprising a frame having a window opening formed therein; a first window sash mounted in the frame at one end of the window opening; a second window sash mounted in the window opening of the frame for movement with respect to the first window sash between a closed position in which it is aligned with the first window sash and serves to close the window opening and at least one open position in which it extends in parallel relation to the first sash to open at least part of the window opening, said frame having a one-piece main frame of a one-piece moulded construction and an auxiliary frame of a one-piece moulded construction that mates with the main frame to define a common frame outline and to combine with said main frame and said first window sash to define guideways to guide said second sash as it moves between said closed position and said open position, each guideway having first and second oppositely disposed side faces, said first guideway having a first portion of its length formed on the main frame and a second portion formed on the second sash, said second side face being formed on said auxiliary frame, said main frame and auxiliary frame being initially separate from one another along a line of separation which extends along said guideways whereby said second face of each guideway which is formed on said auxiliary frame is initially out of cooperative engagement with said second side face.

2. A window assembly as claimed in claim 1, wherein said auxiliary frame consists of a pair of side rails which are only connected to one another by a header and a sill, said main frame further comprises a pair of oppositely disposed side rails, a header and a sill and an intermediate rail which is formed integrally with and extends between the said rails and serves to rigidify the main frame and prevent direct vertical movement of the first window sash, said guideways each bi-passing the intermediate rail to permit free movement of the second window sash to the open position.

3. A window assembly as claimed in claim 1, further comprising a pair of latch bars slidably mounted in said second window sash for movement between an extended and a partial retracted second position in which the actuator bars are withdrawn from the locking recesses but remain seated in said guideways, in which they project laterally from opposite sides of said second window sash into locking recesses formed in each of said guideways, and a single latch bar actuator engaging each latch bar, said actuator being movable relative to the second window sash to simultaneously move said latching bars to and from between said extended and partially retracted positions whereby the movement of both latch bars to the partially retracted position may be effected by said actuator.

4. In a window frame assembly of the type in which fixed and sliding window sashes are aligned with one another when the window is closed and in which the upper end of the sliding window sash is initially tilted rearwardly out of alignment with the fixed window sash such that the sliding window sash can then slide to its open position, and wherein the sliding window sash is guided as it slides by means of first guide channels formed in opposite sides of the window frame assembly, said first guide channels each having oppositely disposed first and second side faces, the improvement wherein the window frame assembly comprises;

(a) a main frame formed from a unitary body of injection molded plastics material, (b) an auxiliary frame formed from a unitary body of injection molded plastics material, (c) said main frame and said auxiliary frame being adapted to be inserted into opposite sides of a window opening to cooperate with one another to secure the window frame assembly in the window opening in use with the fixed sash mounted therein, said fixed sash having a portion of the length of said first side face formed thereon such that it cooperates with the auxiliary frame to define a portion of the length of said guide channel, said main frame and auxiliary frame being separable from one another, when assembled, so as to part along a line of separation which extends along said first guide channel such that the first and second side faces of said first guide channels are on opposite sides of the line of separation and are carried by the main and auxiliary frames respectively.

5. A window assembly as claimed in claim 4, wherein said unitary body of the main frame comprises;

(a) a pair of side rail portions, (b) a header portion extending transversely between the upper ends of the side rail portions, (c) a sill portion extending transversely between the lower ends of the side rail portions, (d) an intermediate rail portion located between the header portion and the sill portion and said intermediate rail being formed integrally with and extending transversely between the side rail portions to form first and second window openings in the main frame on opposite sides thereof, said intermediate rail forming a sill for the fixed window sash and a header for the sliding window sash, said guideways being arranged to by-pass said intermediate rail to permit free movement of the sliding window sash to its open position.

6. A window assembly as claimed in claim 5, wherein said sill portion, side rail portions and intermediate rail portion each have retaining flanges projecting inwardly of the first window opening and cooperating with the sill, side rail and the intermediate rail portions to form a first window seat opening rearwardly therefrom to receive the sliding window sash when it is in the closed position, and wherein a first guide flange projects rearwardly from each of the window retaining flanges of the side rail portions of the sliding window retaining flanges, said first guide flange having an outer edge which forms a first portion of said first side face of said first guide channel, said first portion of said first side face extending from adjacent the sill portion to the intermediate rail portion.

7. A window assembly comprising;

(a) a main frame formed from a unitary body of injection molded plastics material comprising;

(i) a pair of side rail portions, (ii) a header portions extending transversely between the upper ends of the side rail portions, (iii) a sill portion extending transversely between the lower ends of the side rail portions, (iv) an intermediate rail portion located between the header portion and the sill portion and extending transversely between the side rail portions to form first and second window openings in the main frame on opposite sides thereof, said intermediate rail forming sill for a fixed window sash and a header for a sliding window sash and cooperating with the header and side rails to form a seat for a fixed window sash, (b) an auxiliary frame formed from a unitary body of injection molded plastics material comprising, (i) a pair of side rail portions, (ii) a header portion extending transversely between the upper ends of the side rail portions, (iii) a sill portion extending transversely between the upper ends of the side rail portions, said header and sill portions forming the only connection between the side rail portions, (c) said main frame and said auxiliary frame being adapted to be inserted into opposite sides of a window opening to cooperate with one another to secure the window frame assembly in the window opening in use and to retain a fixed window between the header and sill portions.

8. A window assembly as claimed in claim 7, wherein;

(i) said sill portion, said rail portions and the intermediate rail portion each have retaining flange projecting inwardly of the first window opening and cooperating therewith to form a first window seat opening rearwardly therefrom to receive the sliding window sash when it is in the closed position, (ii) said header portion, side rail portions and the intermediate rail portion each having retaining flanges projecting inwardly of the second window opening which cooperate therewith to form a second window seat opening rearwardly therefrom to receive the fixed window sash.

9. In a window frame assembly of the type in which fixed and sliding window sashes are aligned with one another when the window is closed and in which the upper end of the sliding window sash is initially tilted rearwardly out of alignment with the fixed window sash such that the sliding window sash can then slide to its open position, and wherein the sliding window sash is guided as it slides by means of first guide channels formed in opposite sides of the window frame assembly, said first guide channels each having oppositely disposed side faces, the improvement wherein the window frame assembly comprises;

(a) a main frame formed from a unitary body of injection molded plastics material, (b) an auxiliary frame formed from a unitary body of injection molded plastics material, (c) said main frame and said auxiliary frame being adapted to be inserted into opposite sides of a window opening to cooperate with one another to secure the window frame assembly in the window opening in use and being separated from one another, when assembled, along a line of separation which extends along said first guide channel such that the first and second side faces of said first guide channels are on opposite sides of the line of separation and are carried by the main and auxiliary frames respectively, said unitary body of the main frame comprising;

(d) a pair of side rail portions, (e) a header portion extending transversely between the upper ends of the side rail portions, (f) a sill portion extending transversely between the lower ends of the side rail portions, (g) an intermediate rail portion located between the header portion and the sill portion and extending transversely between the side rail portions to form first and second window openings in the main frame on opposite sides thereof, said intermediate rail forming a sill for the fixed window sash and a header for the sliding window sash, (h) said sill portion, side rail portions and intermediate rail portion each have retaining flanges projecting inwardly of the first window opening and cooperating with the sill, side rail and the intermediate rail portions to form a first window seat opening rearwardly therefrom to receive the sliding window sash when it is in the closed position, and wherein a first guide flange projects rearwardly from each of the window retaining flanges of the side rail portions of the sliding window retaining flanges, said first guide flange having an outer edge which forms a first portion of said first side face of said first guide channel, said first portion extending from adjacent the sill portion to the intermediate rail portion, (i) said header portion, said rail portions and the intermediate rail portion each have retaining flanges projecting inwardly of the second window opening which cooperate with the sill, side rail and the intermediate rail portions to form a second window seat opening rearwardly therefrom to receive the fixed window sash when it is in the closed position, (k) a second window sash seated in said second window opening, said second window sash having side rail portions which have an outer edge which forms the remainder of said first side wall of said first guide channel,

(1) said unitary body of the auxiliary frame comprising;

(a) a pair of side rail portions, (b) a header portion extending transversely between the upper ends of the side rail portions, and (c) a sill portion extending transversely between the lower ends of the side rail portions, (d) said side rail portions each having shoulders which are disposed opposite said first side wall of said first guide channel and form said second side wall of said first guide channel when said auxiliary frame is operably mounted with respect to said main frame.

10. A window assembly as claimed in claim 9, wherein a tilting channel extends forwardly from each first guide channel into the first window seat to guide the sliding window sash as it is tilted into and out of the first window seat, the tilting channel having first and second side edges formed on the main frame and the auxiliary frame respectively.

11. A window assembly as claimed in claim 10, wherein locking recesses are formed at the inner end of the tilting channels, the locking recesses extending laterally outwardly with respect to said first window seat and having oppositely disposed side wall portions formed on the main frame and the auxiliary frame respectively.

12. A window assembly comprising;

(a) a main frame formed from a unitary body of injection molded plastics material comprising;

(i) a pair of side rail portions, (ii) a header portions extending transversely between the upper ends of the side rail portions, (iii) a sill portion extending transversely between the lower ends of the side rail portions, (iv) an intermediate rail portion located between the header portion and the sill portion and extending transversely between the side rail portions to form first and second window openings in the main frame on opposite sides thereof, said intermediate rail forming sill for a fixed window sash and a header for a sliding window sash, (v) said sill portion, said rail portions and the intermediate rail portion each have retaining flange projecting inwardly of the first window opening and cooperating therewith to form a first window seat opening rearwardly therefrom to receive the sliding window sash when it is in the closed position, said header portion, side rail portions and the intermediate rail portion each having retaining flanges projecting inwardly of the second window opening which cooperate therewith to form a second window seat opening rearwardly therefrom to receive the fixed window sash.

(b) an auxiliary frame formed from a unitary body of injection molded plastics material, said auxiliary frame comprising
(i) a pair of side rail portions,
(ii) a header portion extending transversely between the upper ends of the side rail portions, and
(iii) a sill portion extending transversely between the lower ends of the side rail portions,
(iv) said side rail portions each having shoulders which are disposed opposite said first side wall of said first guide channel and form said second side wall of said first guide channel when said auxiliary frame is operably mounted with respect to said main frame.

(c) said main frame and said auxiliary frame being adapted to be inserted into opposite sides of a window opening to cooperate with one another to secure the window frame assembly in the window opening in use.

13. In a window assembly of the type having a window frame which has a pair of side rails, a guide channel extending longitudinally of each side rail and a sliding sash mounted for movement along the side rails, the improvement of;

(a) a plurality of locking recesses formed in the guide channels at longitudinally spaced intervals therealong, said locking recesses being arranged in pairs, (b) a pair of latch bars slidably mounted in said sliding sash, each latch bar having a proximal end and a distal end, the distal ends being arranged to project laterally from the sliding window sash, said latch bars being movable relative to the sliding window sash between a fully extended position in which the distal ends project a sufficient distance from the sash to extend into a pair of said locking recesses to prevent movement of the sliding sash and a partially retracted second position in which the distal ends are withdrawn from the locking recesses while remaining in the guide channels to act as guide rods for retaining the sliding sash in and guiding the sliding sash along the guide channels, (c) actuator means mounted on the sliding sash and engaging the proximal ends of each latch bar, said actuator means being manually operable to simultaneously move the latch bars to and fro between the fully extended position and the partially retracted position.

14. In a window frame assembly of the type in which fixed and sliding window sashes are aligned with one another when the window is closed and in which the upper end of the sliding window sash is initially tilted rearwardly out of alignment with the fixed window sash such that the sliding window sash can then slide to its open position, and wherein the sliding window sash is guided as it slides by means of first guide channels formed in opposite sides of the window frame assembly, said first guide channels each having oppositely disposed first and second side faces, the improvement wherein the window frame assembly comprises:

(a) a main frame formed from a unitary body of injection molded plastics material, (b) an auxiliary frame formed from a unitary body of injection molded plastics material, (c) said main frame and said auxiliary frame being adapted to be inserted into opposite sides of a window opening to cooperate with one another to secure the window frame assembly in the window opening in use with the fixed sash mounted therein such that it cooperates with the auxiliary frame to define a portion of the length of said first face of said guide channel, said main frame and auxiliary frame being separable from one another, when assembled, so as to part along a line of separation which extends along said first guide channel such that the first and second side faces of said first guide channels are on opposite sides of the line of separation and are carried by the main and auxiliary frames respectively, (d) said unitary body of the main frame comprises:
(i) a pair of side rail portions,
(ii) a header portion extending transversely between the upper ends of the side rail portions,
(iii) a sill portion extending transversely between the lower ends of the side rail portions,
(iv) an intermediate rail portion located between the header portion and the sill portion and extending transversely between the side rail portions to form first and second window openings in the main frame on opposite sides thereof, said intermediate rail forming a sill for the fixed window sash and a header for the sliding window sash, (e) said sill portion, side rail portions and intermediate rail portion each have retaining flanges projecting inwardly of the first window opening and cooperating with the sill, side rail and the intermediate rail portions to form a first window seat opening rearwardly therefrom to receive the sliding window sash when it is in the closed position, and wherein a first guide flange projects rearwardly from each of the window retaining flanges of the side rail portions of the sliding window retaining flanges, said first guide flange having an outer edge which forms a first portion of said first side wall of said first guide channel, said first portion extending from adjacent the sill portion to the intermediate rail portion.

15. A window assembly as claimed in claim 14, wherein said header portion, each have retaining flanges projecting inwardly of the second window opening which cooperate with the sill, side rail and the intermediate rail portions to form a second window seat opening rearwardly therefrom in which the fixed window sash is seated.

16. A window assembly as claimed in claim 15, wherein said second window sash has side rail portions each of which have an outer edge which forms the remainder of said first side face of said first guide channel.

17. A window assembly as claimed in claim 16, wherein said unitary body of the auxiliary frame comprises;

(a) a pair of side rail portions, (b) a header portion extending transversely between the upper ends of the side rail portions, and (c) a sill portion extending transversely between the lower ends of the side rail portions, (d) said side rail portions each having shoulders which are disposed opposite said first side face of said first guide channel and form said second side face of said first guide channel when said auxiliary frame is operably mounted with respect to said main frame.

18. A window assembly as claimed in claim 17, wherein a tilting channel extends forwardly from each first guide channel into the first window seat to guide the sliding window sash as it is tilted into and out of the first window seat, the tilting channel having first and second side edges formed on the main frame and the auxiliary frame respectively.

19. A window assembly as claimed in claim 18, wherein locking recesses are formed at the inner end of the tilting channels, the locking recesses extending laterally outwardly with respect to said first window seat and having oppositely disposed side wall portions formed on the main frame and the auxiliary frame respectively.

* * * * *